United States Patent [19]

Beretta

[11] Patent Number: 4,693,169

[45] Date of Patent: Sep. 15, 1987

[54] CONTROL DEVICE FOR RAPID FIRING PARTICULARLY AUTOMATIC WEAPONS

[75] Inventor: Pier G. Beretta, Gardone V.T., Italy

[73] Assignee: Fabrica D'Armi P. Beretta S.p.A., Italy

[21] Appl. No.: 843,074

[22] Filed: Mar. 24, 1986

[30] Foreign Application Priority Data

Mar. 22, 1985 [IT] Italy ..... 5139 A/85

[51] Int. Cl.[4] ..... F41D 11/10

[52] U.S. Cl. ..... 89/129.02

[58] Field of Search ..... 89/129.02

[56] References Cited

U.S. PATENT DOCUMENTS 3,345,914 10/1967 Newcomb et al. ..... 89/129.02

FOREIGN PATENT DOCUMENTS 2136101 12/1975 Fed. Rep. of Germany ... 89/129.02

*Primary Examiner*—Stephen C. Bentley

*Attorney, Agent, or Firm*—McGlew and Tuttle

[57] ABSTRACT

Disclosed is a control device for controlling the firing modes of portable, automatic weapons, the components of which are mounted on a support box that is insertable into and removable from, as a unit, the tripping box of the weapon. In the tripping box there is enclosed the tripping mechanism for firing the weapon either singly or in an uncontrolled rapid mode. Between the tripping mechanism and the control for the fire mode, there is interposed a safety shaft which functions also as selector for the desired fire mode, so that by selecting the proper mode, it is possible to have a single shots mode, an uncontrolled rapid fire mode or a controlled rapid fire mode.

13 Claims, 17 Drawing Figures

CONTROL DEVICE FOR RAPID FIRING PARTICULARLY AUTOMATIC WEAPONS

BACKGROUND OF THE INVENTION

In the field of portable automatic weapons, such as machine guns and pistols, snap or spring mechanisms already exist which permit either a semi-automatic firing, that is, with individual shots, by releasing the trigger after each individual shot, or a fully automatic firing, that is, a rapid firing, by keeping the tirgger continuously depressed. In this latter condition, the weapon can automatically and continuously repeat the loading operation and the firing of the cartridges until these are exhausted from the magazine or until the pressing of the trigger has ceased.

Accordingly, such portable automatic weapons, generally, include mechanisms that comprise at least one hammer or striking means, a trigger and a pawl, the three elements interacting for the individual firing operation, a rapid fire level cooperating with the hammer and with the firing pin, so as to obtain the rapid fire operation while keeping the trigger continuously depressed, and, finally, a fire selecting means for determining the mode of firing of the weapon. With these mechanisms, however, it is not possible to have an efficient and proper control of the firing operation in the rapid fire mode, because even if to keep the trigger is depressed for only an additional fraction of time, in excess of the desired one, a totally different number of shots will be fired. Hence, there is a need to provide the portable automatic weapons also with means for controlling and limiting the rapid fire mode of the weapon, to have a more suitable, versatile and reliable utilization of the weapon itself.

BRIEF DESCRIPTION OF THE INVENTION

It is, therefore, an object of the present invention to provide a control device for the firing of automatic weapons, which device, besides permitting single shots as well as rapid fire, allows also a controlled rapid fire mode, that is to say, the firing of a predetermined and limited sequence of shots, while the trigger is kept in the depressed position.

It is another object of the invention to provide a control device for the rapid fire mode of an automatic weapon, which is premounted on a support and is insertable in, as well as removable from, the snap box of the weapon as a unit, so as to rapidly and easily control the weapon, whether it has or has not the provision for the rapid firing mode, without the need for modifying any part or component of the weapon proper.

To this end, the present invention is directed to a control device for the rapid fire mode, the control device being insertable into and removable from the snap box of any portable automatic weapon that comprises at least a hammer, a trigger and a pawl, interacting in the individual fire mode, a rapid fire lever cooperating with the hammer and with the firing pin of the weapon for the rapid fire mode and a safety shaft which acts also as selector of the desired fire mode to define the conditions of the modes of fire, that is, individual shot mode, rapid fire mode or rapid controlled fire mode.

Greater details of the invention will become apparent from the following detailed description thereof, with reference to the accompanying drawings, which are merely illustrative and not limitative of the scope of the invention.

THE DRAWINGS

Figure 16:
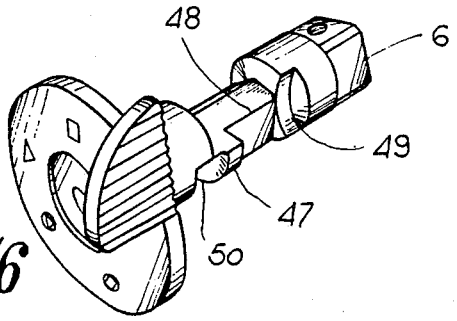
Figure 15:
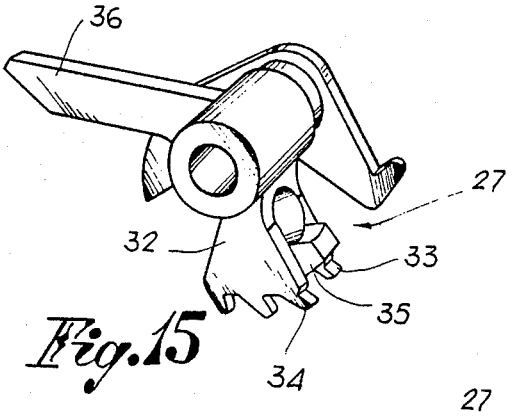
Figure 15A:
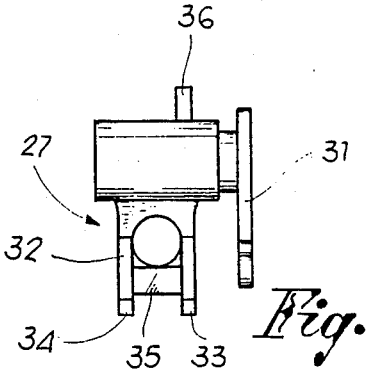

FIGS. 15 and 15*a* are perspective and, respectively, end views of the fire counter or click for the controlled rapid fire mode; and FIG. 16 is a perspective view of the safety shaft with the additional function of fire mode selector.

DETAILED DESCRIPTION OF THE INVENTION

With reference to the accompanying drawings, numeral 1 represents the tripping box of an automatic rifle and numeral 2 represents the breech block of the weapon, which includes a firing pin 3 and is displaceable, in a manner known per se, from a rearward, open position to a forward, closed position.

The following elements are mounted in the tripping box 1: a tripping mechanism 4 for actuating the individual fire mode or the rapid but uncontrolled fire mode; means 5 for controlling the rapid fire mode; and a safety shaft 6 which serves also as mode selector and which is positioned between and cooperates with the tripping mechanism 4 and the control means 5, for the selection of the firing mode. The firing modes are individual shots, uncontrolled rapid fire and controlled rapid fire, as will be described in greater detail hereinafter.

The tripping mechanism 4 substantially comprises a hammer 7, a trigger 8, a tripping pawl 9 and a rapid fire lever 10. Hammer 7 is rotatingly mounted on a pivot 7' and is displaceable to its cocking or arming position by means of the breech block 2. To strike the firing pin 3, hammer 7 is displaceable by means of a preloaded spring 11 mounted on a spring-carrying rod 12 which extends rearwardly. Hammer 7, furthermore, has a lower step 13 alternatively cooperating with trigger 8 or with lever 10. Hammer 7 also as a rear engaging tooth 14 for cooperation with the tripping pawl 9.

Figure 4:
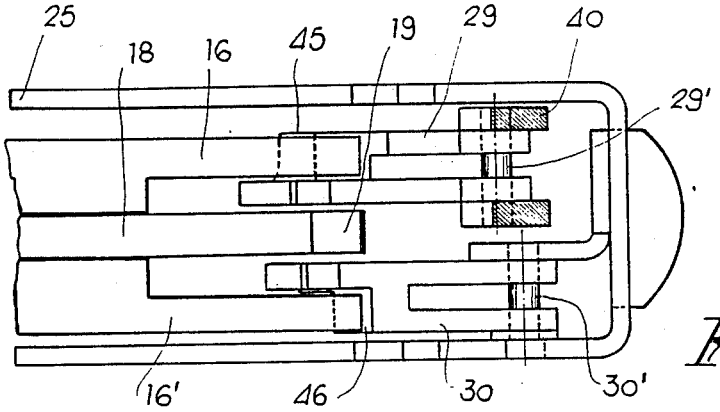
FIG. 4 is a plane view, with parts cut-away, of FIG. 2.
Figure 13:
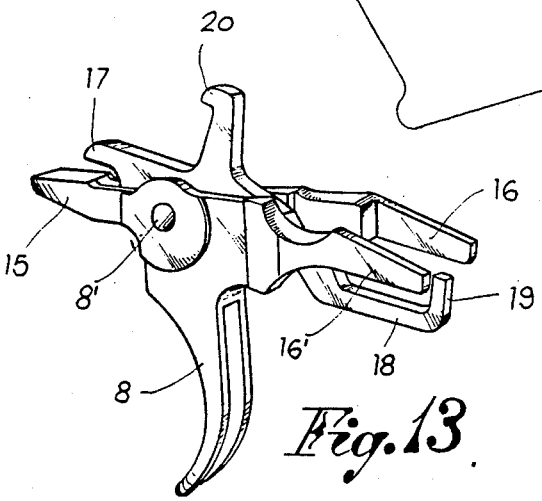
FIG. 13 is a perspective view of the trigger with the pawl attached thereto.

Trigger 8 is mounted within the tripping box 1 by means of pin 8' and has a forward extension 15 which engages the lower step 13 of the hammer 7 in the safety position at the beginning and at the end of the three modes of firing. Trigger 8 also has a pair of parallel tails 16—16' which extend rearwardly, passing underneath the safety shaft 6 (see FIGS. 4 and 13).

The tripping pawl 9 is mounted, in a pivotable manner, on the same pivot 8' of the trigger 8 and has a forward arm 17 which can rest on the extension 15 of the trigger, and a rear arm 18 which extends substantially between the two tails 16—16' of the trigger and which ends with a finger 19 facing upwardly, and an upper arm having a beak 20 for engagement with the tooth 14 of the hammer, so as to arrest the hammer in the armed or cocked position. Between the body of the trigger 8 and the tripping pawl 9 there is provided a spring 21', the action of which tends to keep the tripping pawl 9 normally in the position of engagement of the hammer 7, while the trigger is urged by a suitable recovery spring 21.

The rapid fire lever 10 is also pivotably mounted on pivot 8' of the trigger 8 and has a first arm 22 facing toward and engaging the lower step 13 of the hammer, and a second arm 23 facing upwardly and cooperating, at least during the rapid firing mode, with a pushing cam 2' provided on the carriage-firing pin 2, for the purpose hereinafter explained. The lever 10 is urged by spring 24 (also see FIG. 5) which acts in opposition direction to the action of the cam 2' on the lever itself, so as to normally displace the first arm 22 into a position of with interception of the lower step 13 of the hammer.

Figure 2:
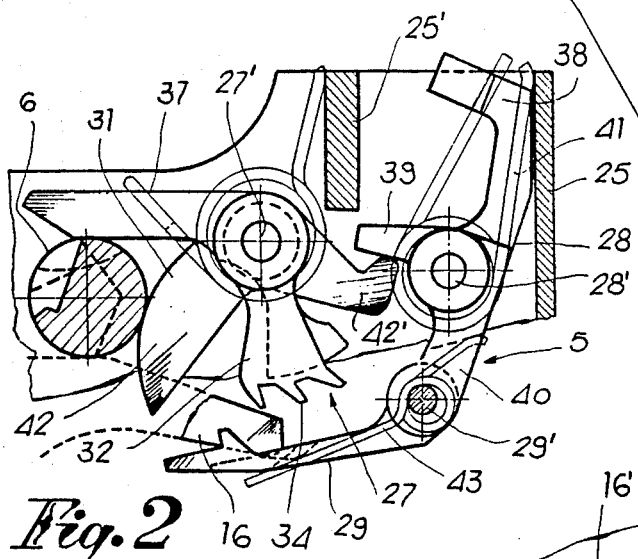
FIGS. 2 and 3 show a detail of the assembly of FIG. 1, illustrating the action of the trigger tails on the controlling and, respectively, arresting claws for the counter means of the rapid fire mode.

All the components of the control mechanism 5 are premounted on a support 25 for their combined insertion and placement, as a unit, in the tripping box 1, in correlation with the tripping mechanism 4. The support 25 comprises a small wing 25' having an opening for receiving the spring-carrying rod 12, of the hammer 7. The support 25 is held fixed in the tripping box 1 by means of a spine 26 and by the safety shaft 6. Explained in greater detail, the control device 5 comprises a ratchet-type shot-counting member, hereafter called the shot counter, 27, a controlled rapid fire lever 28, actuated by the hammer 7 through the spring-carrying rod 12, a control claw 29 connected to the lever 28 for the operation of the shot counter 27, a counter-claw 30 for arresting the shot counter, and a further lever 31 for excluding the controlled rapid fire lever 28 from being operative during the use of the weapon in the individual shot fire mode or in the uncontrolled rapid fire mode (see FIG. 2).

The shot counter 27 is pendularly mounted on a pivot 27' and has a portion 32 facing downwardly and possessing two series of teeth 33 and 34 that are ratchet-like, and spaced apart by a zone with a radial surface 35 for cooperation with the terminal finger 19 of the rear arm 18 of the pawl 9 (also see FIG. 15). The two series of teeth of the shot counter are, respectively, in correspondence with the controlling claw 29 and the arresting claw 30 and comprise two, three or more teeth, depending on the number of shots to be controllably fired.

The shot counter 27 is also provided with an arm 36 which extends above the safety shaft 6 and cooperates therewith, said arm being urged by a spring 37 that tends to displace it normally toward the safety shaft 6 and to keep correspondingly the toothed portion 33-34 rotated rearwardly, that is to say in opposition to the action of the controlling claw 29.

Figure 3:
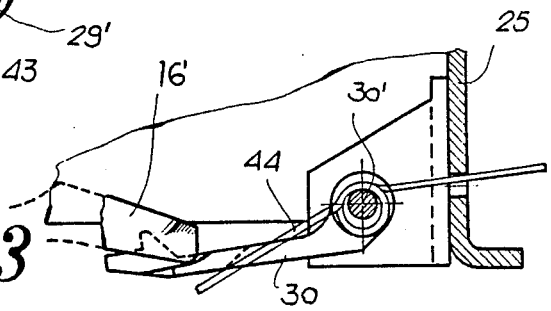

The controlled rapid fire lever 28 is mounted on a pivot 28' and has, on one side of said pivot, an upper arm 38 aligned with the spring-carrying rod 12 and an intermediate finger 39 with which the lever 31 is engaged, and, on the opposed side of said pivot, a portion 40 on which the controlling claw 29 of the shot counter 27 pivots at 29'. The arresting counter-claw 30 pivots, instead, on the support 25 by means of a pivot 30', as shown in detail in FIGS. 3 and 4 of the accompanying drawings.

The controlled rapid fire lever 28 is actuated by a spring 41, which normally keeps the upper arm 28 thereof displaced toward the spring-carrying rod 12, in opposition to the action of the lever 31 on the intermediate finger 39. The lever 31, which excludes from operation the controlled rapid fire lever 28, is in fact mounted axially with respect to the shot counter 27 and is provided with an arm 42 which cooperates with the selector shaft 6, and a second arm 42' which engages the finger 39, so as to displace and keep the lever 28 in the inoperative position, when the weapon is used in the individual shot fire mode or in the uncontrolled rapid fire mode.

It is to be observed also that the controlling claw 29 and the arresting counter-claw 30 are urged by springs 43 and, respectively, 44 which tend to keep them in contact with the teeth 33-34 of the shot counter 27 and is each provided with a lateral plane or surface 45 and 46, respectively. On these surfaces 45-46 are engaged the tails 16—16' of the trigger 8, when the weapon is in safety position, as well as when, at the end (as explained later on) of the controlled rapid fire operation, when it becomes necessary to space the claws from the teeth of the shot counter.

Finally the safety shaft 6 has cammed portions 47,48,49,50 which cooperate, respectively, with one of the tails 16—16' of the trigger, with the rear arm 18 of the pawl, with the exclusion lever 31 and with the arm 36 of the shot counter, so as to obtain the engagement of the safety device or the selection of the various modes of operation of the weapon, indicated on an extremity or terminal disc which is integral with the safety shaft and is provided with a manouver lever (see FIG. 16).

Figure 1:
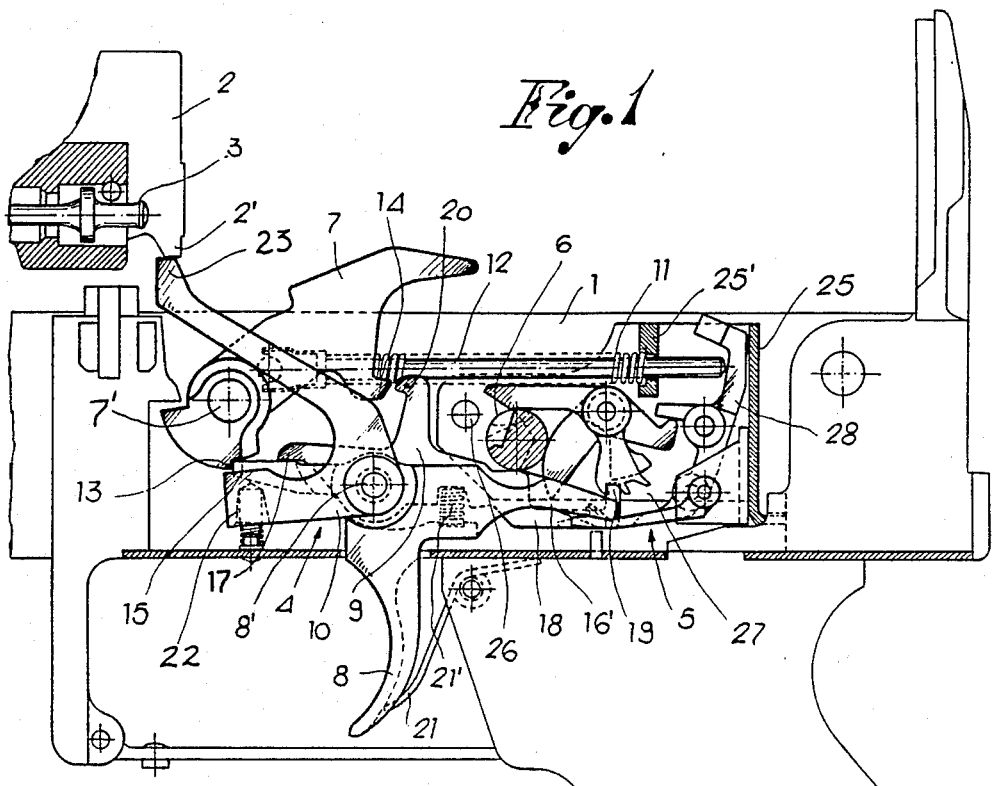
FIG. 1 shows a portion of a rifle with the tripping mechanism in the safety position and with the breech block displaced forwardly in the closed position.

In FIG. 1 of the drawings, there is shown the overall assembly of the mechanism in position of safety, with breech block closed and with hammer cocked. In this condition, the trigger is at rest and its forward extension 15 engages the lower step 13 of the hammer, blocking it while the rapid fire lever 10 is kept in a condition of non-influence on the part of the tooth 2' of the breech block. The safety shaft 6 is rotated, so as to engage and block (by means of the proper cammed portions 47 and 48) the tail 16' of the trigger and the rear arm 18 of the pawl 9. In this way, the trigger 8 cannot be moved and the tripping pawl 9 is kept in inoperative condition, that is, without engaging with its beak 20 the rear tooth 14 of the hammer 7.

On the other hand, the cammed portion of the safety shaft engages the exclusion lever 31, so as to displace and keep the controlled rapid fire lever 28 at rest, while the cammed portion 50 engages the arm 36 of the shot counter 26, in order to block it. Furthermore, the tails 16—16' of the trigger rest on the claw 29 and on the counter-claw 30, keeping them spaced from the shot-counter 27 and, therefore, in the inoperative position (see also FIGS. 2–3).

Starting from the condition of safety, it is then necessary to rotate the selector shaft 6, in order to set the weapon to the individual shot fire mode or to the controlled rapid fire mode or to the uncontrolled continuous rapid fire mode.

Figure 5:
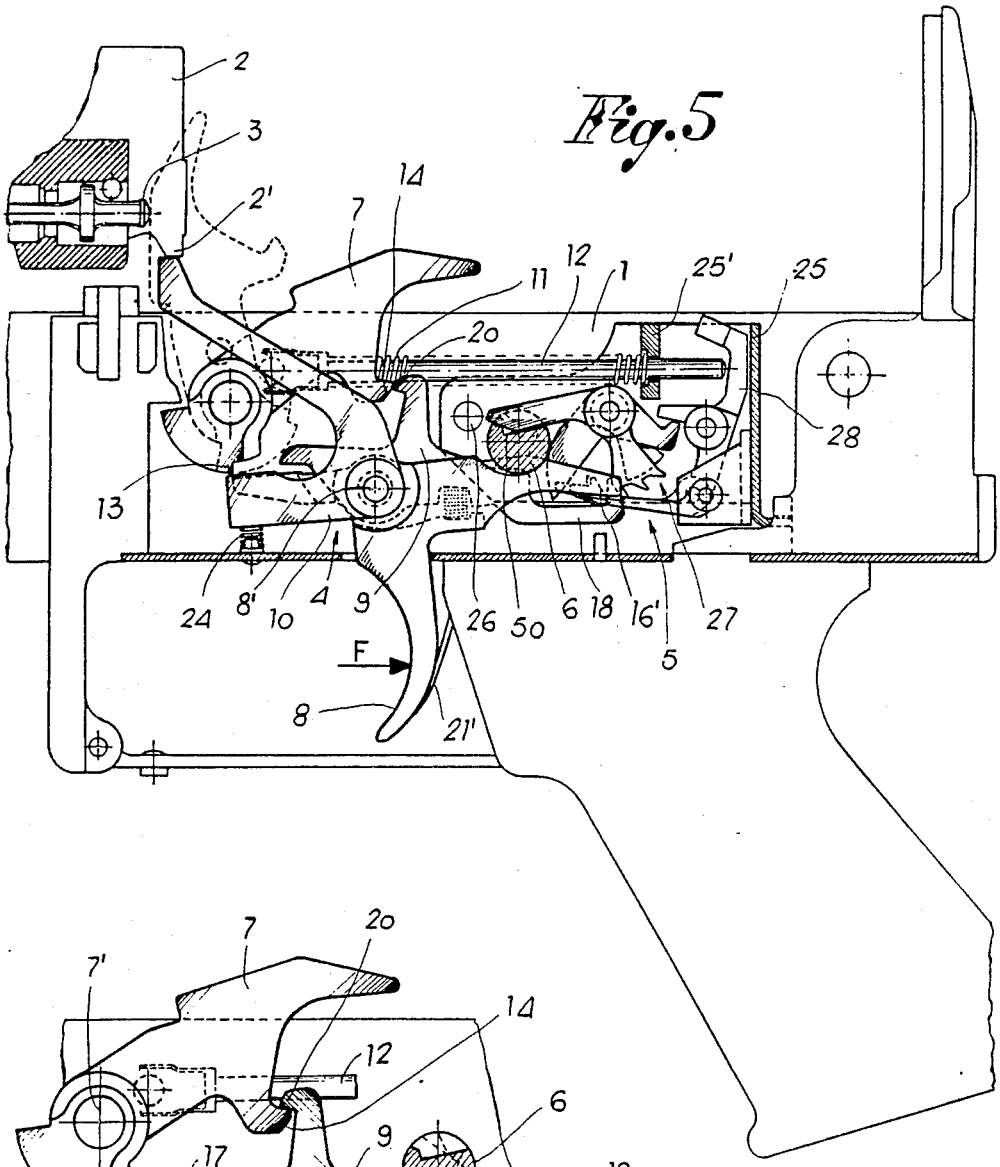
FIG. 5 is an analogous view to that of FIG. 1, but with the tripping mechanism in a first stage or phase of the individual fire mode.
Figure 6:
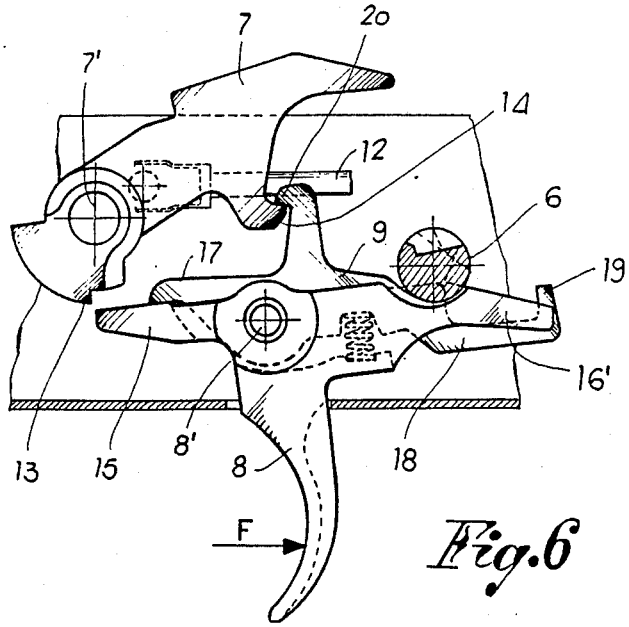
FIG. 6 shows a detail of the assembly of FIG. 5, in a second and subsequent stage or phase of the individual fire mode.

For firing individual shots see FIGS. 5 and 6 the selector shaft 6 is rotated, so as to allow the displacement of the trigger and of the tripping pawl 9. Lever 28 is kept still at rest by the exclusion lever 31, which is still engaged by the corresponding cammed portion 49, while the shot counter 27 (because of the rotation of the shaft 6 and because of the urging by the spring 37) moves away from the finger 19 (rear finger) of the tripping pawl and outside of the action zone of the claws 29–30. The claws 29–30, free from the arresting action of the tails 16—16' of the trigger, are displaced toward the shot counter 27. As a result, the trigger 8 may be depressed and actuated in the direction of the arrow F (see FIGS. 5 and 6), so as to free the hammer 7 from the blocking action of the forward extension 15 of the trigger for the firing of the first shot (phantom lines in FIG. 5). When the hammer 7 moves into the armed or cocked position, as a result of the recoiling of the breech block 2, it is engaged and blocked by beak 20 of the pawl 9, which engages with the rear tooth 14 of the hammer (see FIG. 6). This is so even when the trigger 8 is still depressed. In order to fire the subsequent shot, it is necessary to let go of the trigger and then depress it again, so as to displace, together with it, the tripping pawl 9, in the direction for disengaging the pawl 9 from the hammer. During the individual shot fire mode, the lever 10 remains without influence and the spring-carrying rod 12 of the hammer does not act upon the controlled rapid fire lever 28.

Figure 7:
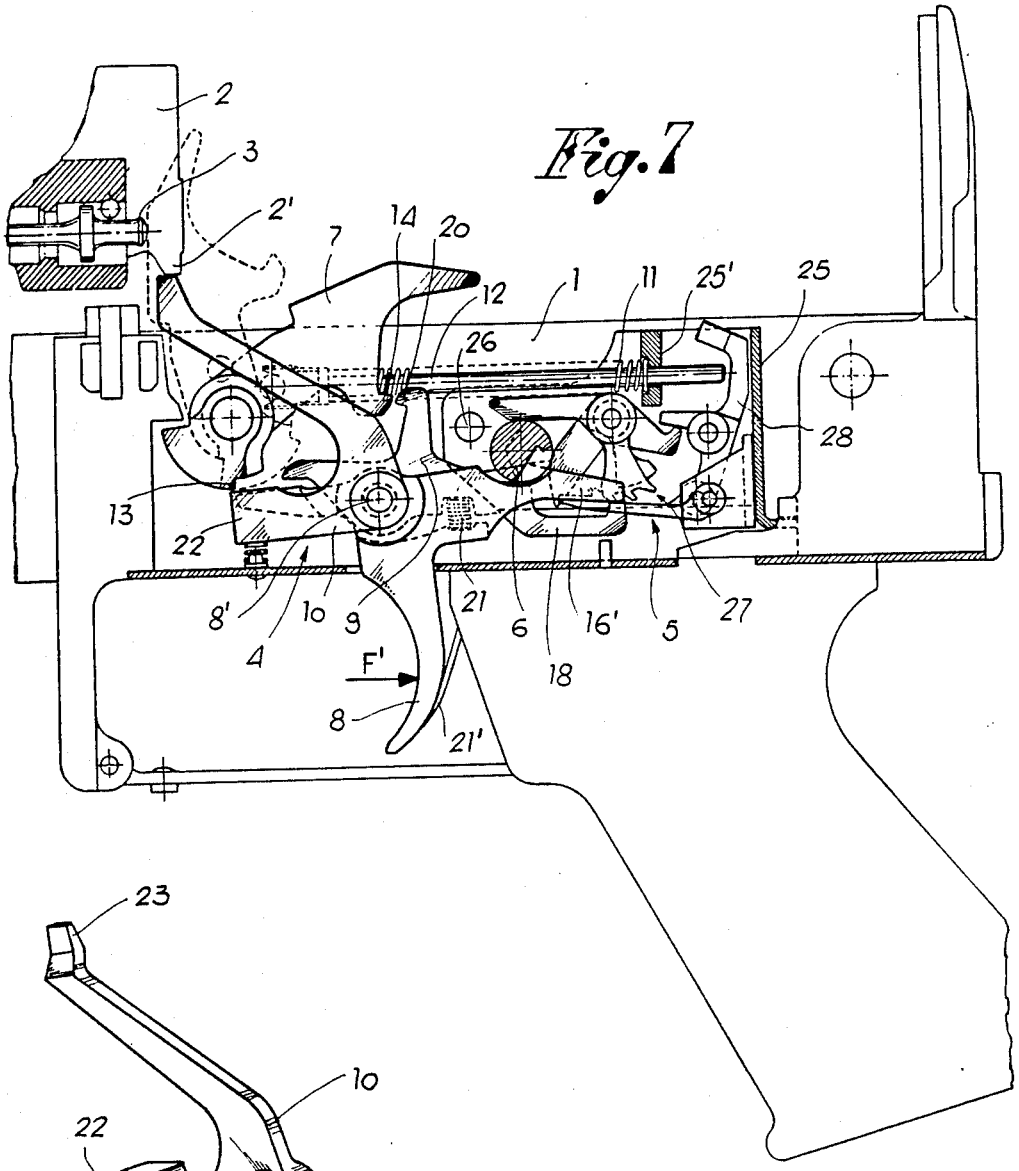
FIG. 7 shows the mechanism preset for the beginning of the rapid fire continuous mode.
Figure 14:
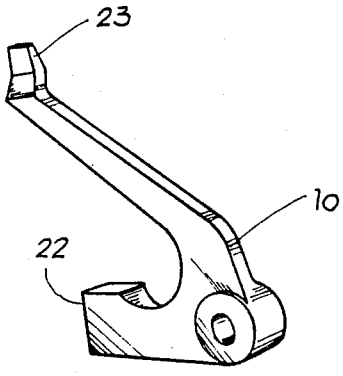
FIG. 14 is a perspective view of the rapid fire lever alone.
Figure 8:
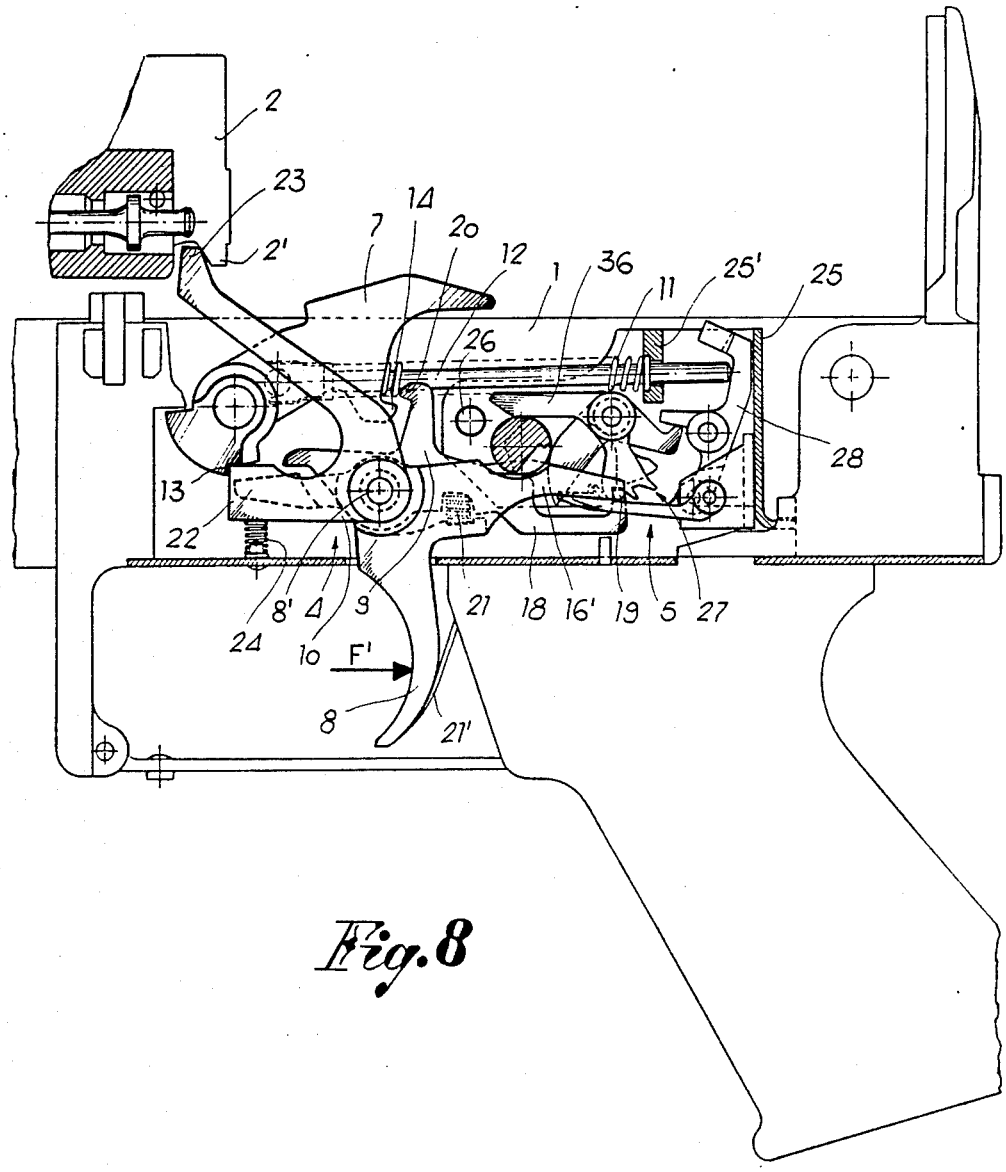
FIG. 8 shows the disengagement of the hammer during the continuous rapid fire mode.

For rapid, automatic fire in the uncontrolled mode, the selector shaft 6 is rotated, so as to permit the manouver of the trigger 8 and to block, in the inoperative position, the controlled rapid fire lever 28 by means of the exclusion lever 31 (see FIGS. 7 and 8). The shot counter 27, due to the cammed portion 49 of the selector shaft 6, is positioned instead so as to intercept, with the radial portion 35, the finger 19 of the rear arm 18 of the tripping pawl 9, and thus to limit the displacement thereof. This occurs in order to prevent the upper beak 20 of the tripping pawl 9 from engaging the rear tooth 14 of the hammer while the weapon is in the rapid fire mode.

In such a condition (shown in FIG. 7 of the drawings) by depressing the trigger 8 according to arrow F' one obtains the disengagement of the hammer 7 for the firing of a first shot, as in the case of firing a single, individual shot. By keeping the trigger depressed, one obtains the automatic, rapid fire mode up to the exhaustion of the cartridges in the magazine.

After every shot, recoiling breech block 2, moves the hammer 7 in the cocked position where it comes to be blocked by the first arm 22 of the lever 10 engaged with the step 13 of the hammer (see FIG. 8), while the tripping pawl 9 remains inoperative. Such a blocking of the hammer is, however, only temporary, because with the subsequent return of the breech block into the closed position, the tooth 2' thereof acts on the second arm 23 of the lever 10, moving its lever counter-clockwise (see FIG. 8), so as to disengage automatically the hammer for the firing of the weapon and the automatic exiting of another shell. In actuality, lever 10 engages and disengages the hammer 7 in synchronism with the opening and closing displacements, respectively, of the breech block 2.

Also in this case the displacements of the spring-carrying rod, concurrently with the hammer, have no influence on the lever 28 which is kept in the inoperative position by the exclusion lever 31.

Figure 9:
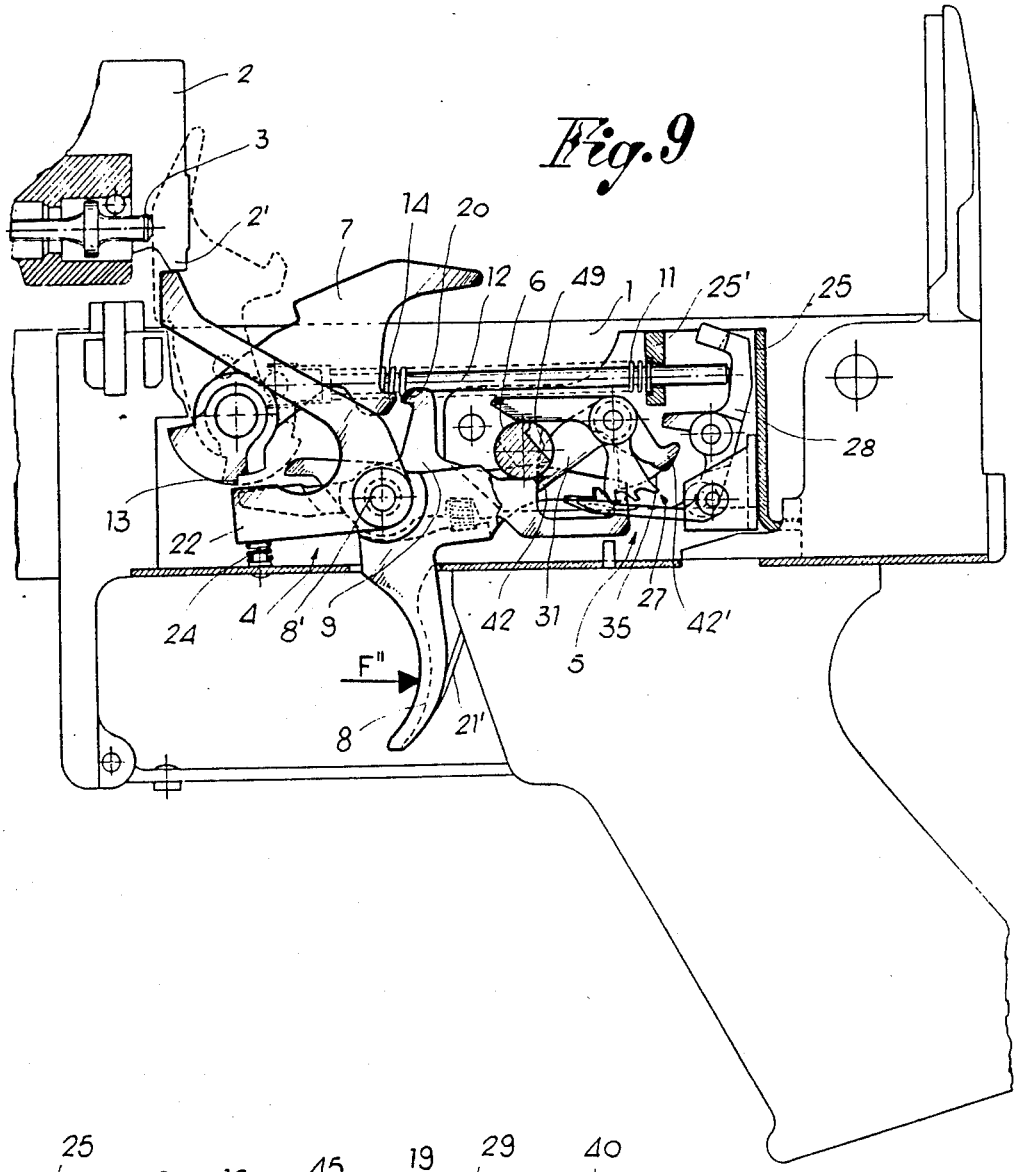
FIG. 9 is an analogous view to that of FIG. 5, but with the mechanism in the position of beginning the firing of the first shot of a controlled rapid fire mode.
Figure 10:
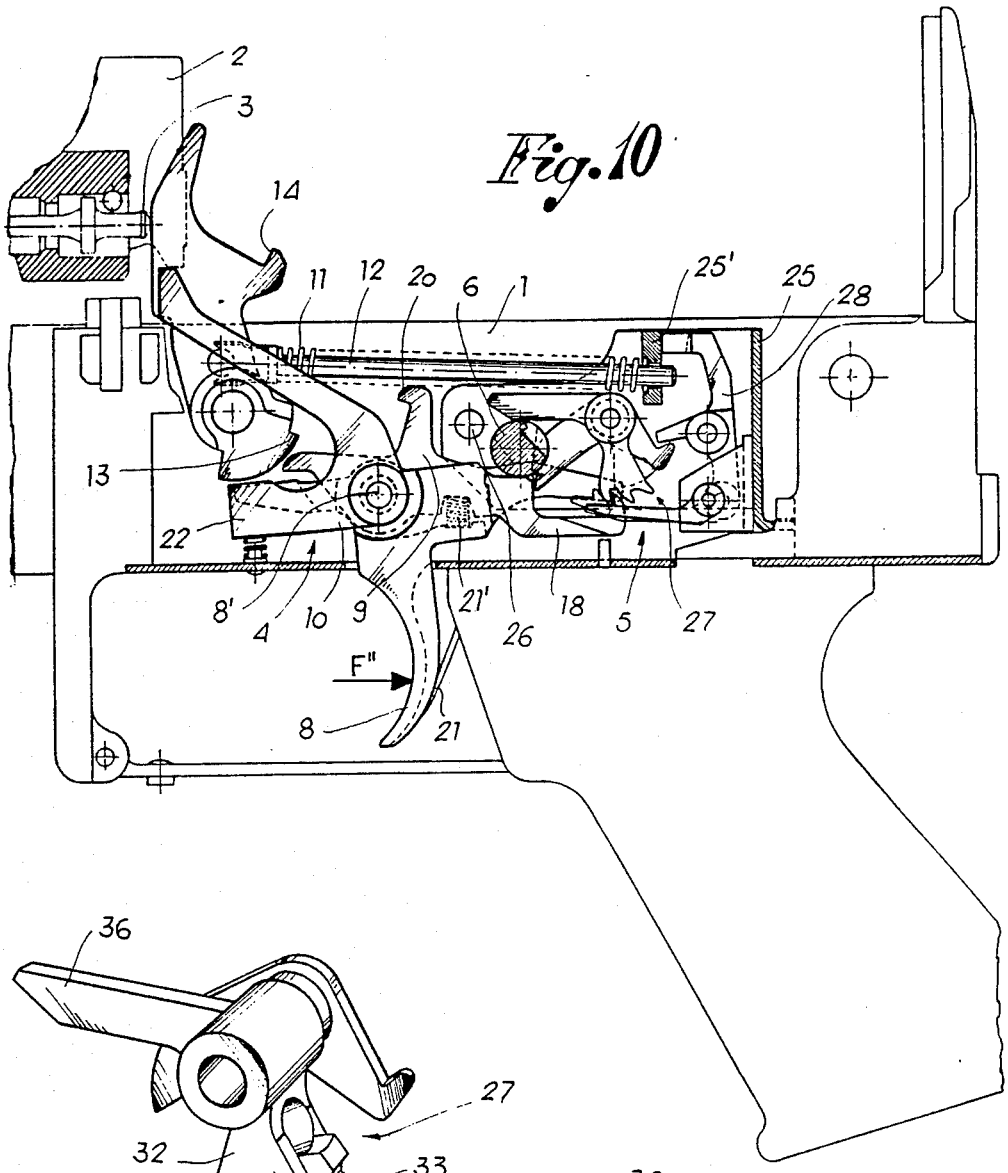
FIG. 10 shows the mechanism in the condition of beginning the counting of the shots during the controlled rapid fire mode.
Figure 11:
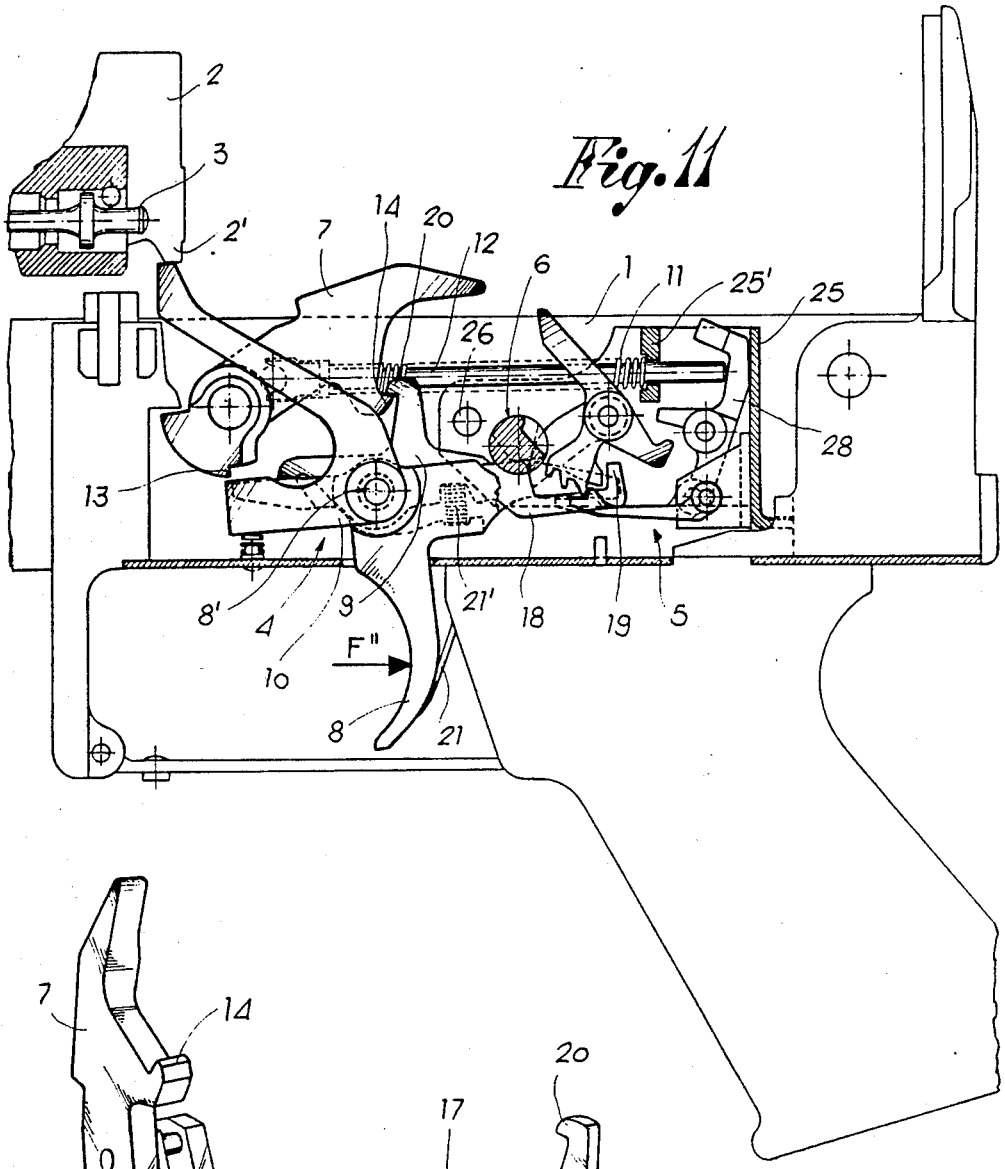
FIG. 11 shows the mechanism in the final position, that is, in the position of rest, of the controlled rapid fire mode.
Figure 12:
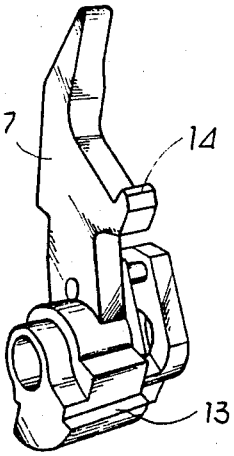
FIG. 12 is a perspective view of the hammer alone.

Finally, for the rapid fire (controlled) mode, the selector shaft 6 is rotated and positioned as shown in FIGS. 9–10–11 of the drawings. Then, the trigger 8 may be depressed and, therefore, actuated, while the tripping pawl 9 is blocked, even if only temporarily, by the shot counter 27. Shot counter 27, in fact, because of the action of the cammed portion 50 of shaft 6 on the arm 36 of the shot counter 27, comes to be positioned so as to cooperate with the claw 29 and with the counter-claw 30 and, concurrently, to intercept with the radial portion 35, the terminal finger 19 of the pawl, so that the engagement of the hammer by the beak 20 is prevented, as in the case of firing continuously without control. On the other hand, the cammed portion 49 of the selector shaft 6 is positioned, so as to permit a displacement of the exclusion lever 31 in the inoperative position, thus freeing the lever 28 for interaction with the spring-carrying rod 12. This will also cause the claw 29 to actuate the shot counter 27.

In particular, FIG. 9 of the accompanying drawings illustrates the condition of firing the first shot of a controlled rapid fire mode, in which condition the depression of the trigger (arrow F'') determines the disengagement of the hammer 7, as in the case of the individual shot firing mode, in which the first shot is fired. With the displacement of the hammer 7 toward the firing pin 3, the spring-carrying rod 12 moves forwardly and allows a concurrent displacement of the lever 28 and, therefore, a displacement in the rearward direction of the claw 29. This latter then comes into engagement with the first tooth of the corresponding plurality of teeth 33 of the shot counter 27, as shown in FIG. 10.

Subsequently, following the firing of the cartridge, the breech block recoils and displaces the hammer 7 to the cocked position, where it is temporarily held by the first arm 22 of the rapid fire lever 10. Such a displacement of the hammer results also in a movement in the rearward direction of the spring-carrying rod 12, which angularly moves the lever 28 on its pivot 28' in a direction opposite to the previous one.

It follows that that there is a positive movement, forward, of the controlling claw 29, causing the advancing of the shot counter 27 by one notch or step, so as to count the occurrance of a first shot. In a parallel sense, the counter-claw 30 engages the first tooth of the corresponding plurality of teeth 34 of the shot counter 27.

The subsequent return of the carriage-firing pin 2 in the closed position, keeping always the trigger depressed, determines (through its tooth 2') the displacement of the lever 10 for the automatic disengagement of the hammer 7, as in the case of the firing in the uncontrolled rapid fire mode, for the firing of another shot. The above described sequence is then repeated; that is to say, the displacement of the hammer 7, of the rod 12, of the lever 28 and of the claw 29 for the advancement of the shot counter 27 by a further notch or step, while the counter-claw 30, in cooperation with the corresponding teeth 34, prevents the movement of the shot counter 27 by the spring 37 during the passive run of the claw 29.

This will continue until the shot counter 27 has moved as many notches or steps as there are teeth 33 in the counting process. This will result in the firing of a corresponding number of shots.

In the case illustrated, the shot counter 27, having three counter teeth 33, allows the controlled rapid fire of three consecutive shots.

With the firing of the last shot of the controlled rapid fire mode (see FIG. 11) the shot counter 26 comes to rest in a position, in which its radial portion 35 is moved away from the finger 19 of the tripping pawl 9. The pawl, no longer limited in its displacements, comes to rest in a position of interception and arrest of the rear tooth 14 of the hammer by means of the beak 20. So, when the hammer 7 moves into a cocked position, after the firing of the last shot, it is arrested and blocked by the beak 20 of the pawl 9, as shown in FIG. 11. In this condition, the mechanism is automatically blocked, interrupting the rapid firing mode even if the trigger is still depressed.

In order to resume the cycle of controlled rapid firing, it is necessary to let go of the trigger, so that it may return to rest. Then, the forward extension 15 of the trigger 8 engages the lower step 13 of the hammer, so as to block the latter in the cocked position, immediately before the disengagement of the tripping pawl (which is moving concurrently with the trigger 8 thanks to the help of arm 17 on the extension 15) from the hammer due to the blocking caused by the beak 20.

At the same time, the tails 16—16' of the trigger 8 come to rest on the claw 29 and on the counter-claw 30, so as to lower them and disengage them from the respective teeth of the shot counter 27. The shot counter 27, urged by the spring 37, returns to the initial position, that is to say, the "zero" position, in which—see FIG. 9—its arm 36 rests on the selector shaft 6, its teeth 33–34 are all displaced rearwardly with respect to the two claws 29–30, and its radial portion 35 intercepts the terminal finger 19 of the tripping pawl 9, so as to limit the displacement thereof and prevent the blocking action of its beak 20 on the tooth 14 of the hammer.

At this point it is possible to repeat another cycle of firing in the controlled rapid fire mode, or by moving suitably the selector shaft 6, set the mechanism to the safety position or establish the firing mode (individual shots or uncontrolled rapid fire mode), according to the above described operational procedure.

What is claimed is:

1. A device for controlling the firing modes of a portable, automatic weapon, comprising:

(a) a breech block having a firing pin thereon and displaceable from a rear open position to a forward closed position;

(b) a tripping box with a tripping mechanism therein which includes:

(i) a spring-loaded hammer and a spring engaged with said hammer, said hammer being displaceable to a cocked position upon the opening of said breech block, and displaceable to a firing position upon urging by said spring, which spring being mounted on a spring-carrying rod that moves in accordance with the displacements of said hammer;

(ii) a trigger depressable to fire the weapon;

(iii) a safety shaft having a safety position and functioning also as a selector, said shaft having positions for said firing modes, said modes being a first individual shot fire mode, a second uncontrolled rapid fire mode, and a third controlled fire mode;

(iv) a first lever cooperating with said hammer and with said breech block when said safety shaft is in a position for said second fire mode and while said trigger is kept depressed; and (v) a tripping pawl mounted to interact with said hammer to hold it in the cocked position during said first fire mode;

(c) a pendular, shot counter having at least one series of teeth for counting the shots fired sequentially during said third mode; said counter having a radial portion engaged with said tripping pawl for limiting the displacement of said pawl and preventing the interaction of said pawl with said hammer during said second and third fire modes;

(d) a pivoting reciprocatingly displaceable second lever for said third fire mode, actuated by said hammer through said spring-carrying rod;

(e) a controlling claw connected to said second lever, positively displaceable for engagement with said teeth of said counter and for advancement of said counter by one count following the cocking of said hammer after the firing of each controlled shot, and passively displaceable as a result of its disengagement from said hammer;

(f) a blocking counter-claw for arresting said counter during said passive displacement of said controlling claw; and (g) a third lever for excluding said second lever from said third fire mode, said third lever engaging a first cammed portion of said safety shaft for displacement of said second lever to a rest position when the weapon is in one of the safety position, said first fire mode and said second fire mode.

2. The device of claim 1 wherein said counter comprises a second series of teeth cooperating with said blocking counter-claw.

3. The device of claim 1, wherein said counter has an arm cooperating with a second cammed portion of said safety shaft for positioning said counter in a non-interception position with said pawl during said first fire mode or in an interception and blockage position with said pawl during said second and third fire modes;

4. Device according to claim 1, wherein said third lever is mounted axially with respect to said counter and has a first arm for contacting said first cammed portion of said safety shaft, and a second arm facing and cooperating with a finger of said third lever, so as to block said third lever in a position away from said spring-carrying rod, when the shaft is in safety position or during said first or second fire modes.

5. The device of claim 1, wherein said counter, said second lever, said controlling claw, said counter-claw and said third lever are all mounted within a support box for their insertion into and extraction from, said tripping box; said support box having a small wing with an opening therein for guiding and sliding therethrough said spring-carrying rod.

6. The device of claim 5, wherein said trigger has two tails said tripping box has mounted therein and transversely thereto and to said support, the safety shaft, so as to be positioned between said tails of said trigger and said tripping pawl, on one side, and the arm of said counter and the first arm of said third lever, on the other side.

7. Device according to claim 5, wherein said controlling claw is pivotable on said second lever, while said blocking counterclaw is pivotable on said support box.

8. A device for controlling the firing modes of a portable, automatic weapon comprising:

(a) a breech block having a firing pin thereon and displaceable from a rear open position to a forward closed position;

(b) a tripping box with a tripping mechanism therein which includes:

(i) a spring-loaded hammer and a spring engaged with said hammer, said hammer being displaceable to a cocked position upon the opening of said breech block, and displaceable to a firing position upon urging by said spring, which spring being mounted on a spring-carrying rod that moves in accordance with the displacements of said hammer;

(ii) a trigger depressable to fire the weapon;

(iii) a safety shaft having a safety position and functioning also as a selector, said shaft having positions for said firing modes, said modes being a first individual shot fire mode, a second uncontrolled rapid fire mode, and a third controlled fire mode;

(iv) a first lever cooperating with said hammer and with said breech block when said safety shaft is in a position for said second fire mode and while said trigger is kept depressed; and (v) a tripping pawl mounted to ionteract with said hammer to hold it in the cocked position during said first fire mode;

(c) a pendular, shot counter having at least one series of teeth for counting the shots fired sequentially during said third mode;

(d) a pivoting reciprocatingly displaceable second lever for said third fire mode, actuated by said hammer through said spring-carrying rod;

(e) a controlling claw connected to said second lever, positively displaceable for engagement with said teeth of said counter and for advancement of said counter by one count following the cocking of said hammer after the firing of each controlled shot, and passively displaceable as a result of its disengagement from said hammer;

(f) a blocking counter-claw for arresting said counter during said passive displacement of said controlling claw; and (g) a third lever for excluding said second lever from said third fire mode, said third lever engaging a first cammed portion of said safety shaft for displacement of said second lever to a rest position when the weapon is in one of the safety position, said first fire mode and said second fire mode;

said trigger having a forward extension engaging a forward arm of said pawl for the con-current displacement of said trigger and said pawl during the disengagement of said hammer from said pawl; said trigger having two rear tails resting respectively on said controlling claw and blocking claw, for moving them away from said counter when said trigger is at rest, and for resetting said counter at the end of said third fire mode.

9. The device of claim 8, wherein said counter, said second lever, said controlling claw, said counter-claw and said third lever are all mounted within a support box for their insertion into and extraction from, said tripping box as a unit; said support box having a small wing with an opening therein for guiding said spring-carrying rod.

10. The device of claim 9, wherein said tripping box has mounted therein and transversely thereto and to said support, the safety shaft so as to be positioned between said tails of said trigger and said tripping pawl, on one side and the arm of said counter and the first arm of said third lever, on the other side.

11. The device according to claim 9, wherein said controlling claw is pivotable on said second lever, while said blocking counter-claw is pivotable on said support box.

12. The device according to claim 8, wherein said counter comprises a second series of teeth cooperating with said blocking counter-claw.

13. The device of claim 8, wherein said counter has an arm cooperating with a second cammed portion of said safety shaft for positioning said counter in a non-interception position with said pawl during said first fire mode or in an interception and blockage position with said pawl during said second and third fire modes.

* * * * *

UNITED STATES PATENT AND TRADEMARK OFFICE

CERTIFICATE OF CORRECTION

PATENT NO. : 4,693,169

DATED : September 15, 1987

INVENTOR(S) : Pier G. Beretta

It is certified that error appears in the above-identified patent and that said Letters Patent is hereby corrected as shown below:

On the title page assignee should read

-- (73) Assignee: Fabbrica D'Armi P. Beretta S.p.A. --.

Signed and Sealed this

Sixteenth Day of February, 198[illegible]

*Attest:*

DONALD J. QUIGG

*Attesting Officer*

*Commissioner of Patents and Trademarks*